US012515902B2

(12) United States Patent
Ishikawa

(10) Patent No.: US 12,515,902 B2
(45) Date of Patent: Jan. 6, 2026

(54) SHEET CONVEYING DEVICE

(71) Applicant: TOSHIBA TEC KABUSHIKI KAISHA, Tokyo (JP)

(72) Inventor: Ryuta Ishikawa, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 205 days.

(21) Appl. No.: 18/358,065

(22) Filed: Jul. 25, 2023

(65) Prior Publication Data

US 2025/0033911 A1 Jan. 30, 2025

(51) Int. Cl.

| | |
|---|---|
| ***B65H 5/36*** | (2006.01) |
| ***B65H 5/06*** | (2006.01) |
| ***B65H 7/02*** | (2006.01) |
| ***B65H 9/00*** | (2006.01) |

(52) U.S. Cl.

CPC ..... *B65H 5/36* (2013.01); *B65H 5/062* (2013.01); *B65H 7/02* (2013.01); *B65H 9/006* (2013.01); *B65H 2301/333* (2013.01); *B65H 2404/65* (2013.01); *B65H 2404/7414* (2013.01); *B65H 2511/13* (2013.01); *B65H 2511/22* (2013.01); *B65H 2801/06* (2013.01)

(58) Field of Classification Search

CPC ..... B65H 5/062; B65H 5/36

See application file for complete search history.

(56) References Cited

U.S. PATENT DOCUMENTS

| | | | | |
|---|---|---|---|---|
| 9,791,814 | B2 * | 10/2017 | Endo | G03G 21/1619 |
| 2003/0151191 | A1 * | 8/2003 | Watase | G03G 15/6567 271/242 |
| 2015/0137443 | A1 * | 5/2015 | Yamamoto | B65H 85/00 271/274 |
| 2016/0145063 | A1 * | 5/2016 | Segers | B65H 29/58 271/225 |
| 2020/0307934 | A1 * | 10/2020 | Maruyama | B65H 5/062 |
| 2023/0055294 | A1 * | 2/2023 | Ishioka | B65H 5/36 |

FOREIGN PATENT DOCUMENTS

| | | |
|---|---|---|
| JP | 06-64792 | 3/1994 |
| JP | 08-73070 | 3/1996 |
| JP | 2015016978 A * | 1/2015 |

* cited by examiner

*Primary Examiner* — Prasad V Gokhale

(74) *Attorney, Agent, or Firm* — Amin, Turocy & Watson, LLP

(57) ABSTRACT

A sheet conveying device in an embodiment includes a first roller unit, a first conveyance path, a guide mechanism, and a control section. The first roller unit rotates and conveys a sheet. The first conveyance path conveys the sheet to the first roller unit. The guide mechanism is disposed along the first conveyance path and guides the conveyance of the sheet. The guide mechanism is capable of changing a conveyance path width. The control section sets the conveyance path width at a time when a leading end of the sheet passes a first position of the guide mechanism to first width. The control section sets the conveyance path width at a time when a trailing end of the sheet passes the first position to second width smaller than the first width.

12 Claims, 6 Drawing Sheets

SHEET CONVEYING DEVICE

FIELD

Embodiments described herein relate generally to a sheet conveying device, a sheet conveying method, and an image forming apparatus.

BACKGROUND

An image forming apparatus forms an image on a sheet. The image forming apparatus includes a sheet conveying device. The sheet conveying device is requested to suppress noise during sheet conveyance.

DETAILED DESCRIPTION

A sheet conveying device in an embodiment includes a first roller unit, a first conveyance path, a guide mechanism, and a control section. The first roller unit rotates while forming a first nip with a pair of rollers and conveys a sheet having reached the first nip. The first conveyance path conveys the sheet to the first roller unit. An upstream side in a conveying direction of the first conveyance path is represented as a first side in a first direction. A thickness direction of the sheet conveyed on the first conveyance path is represented as a second direction. The guide mechanism is disposed along the first conveyance path and guides the conveyance of the sheet. The guide mechanism is capable of changing a conveyance path width, which is width in the second direction of the first conveyance path. The control section is capable of controlling the guide mechanism as follows. The control section sets the conveyance path width at a time when a leading end of the sheet passes a first position of the guide mechanism to first width. The control section sets the conveyance path width at a time when a trailing end of the sheet passes the first position of the guide mechanism to second width smaller than the first width. In another embodiment, a sheet conveying method involves rotating a first roller while forming a first nip with another roller and conveying a sheet having reached the first nip; conveying the sheet to the first roller via a first conveyance path; guiding, using a guide mechanism disposed along the first conveyance path, the conveyance of the sheet and changing a conveyance path width, the conveyance path width exists in a second direction of the first conveyance path, if an upstream side in a conveying direction of the first conveyance path is represented as a first side in a first direction and a thickness direction of the sheet conveyed on the first conveyance path is represented as the second direction; and setting the conveyance path width at a time when a leading end of the sheet passes a first position of the guide mechanism to a first width and setting the conveyance path width at a time when a trailing end of the sheet passes the first position of the guide mechanism to a second width smaller than the first width.

The sheet conveying device in the embodiment is explained below with reference to the drawings.

Figure 1:
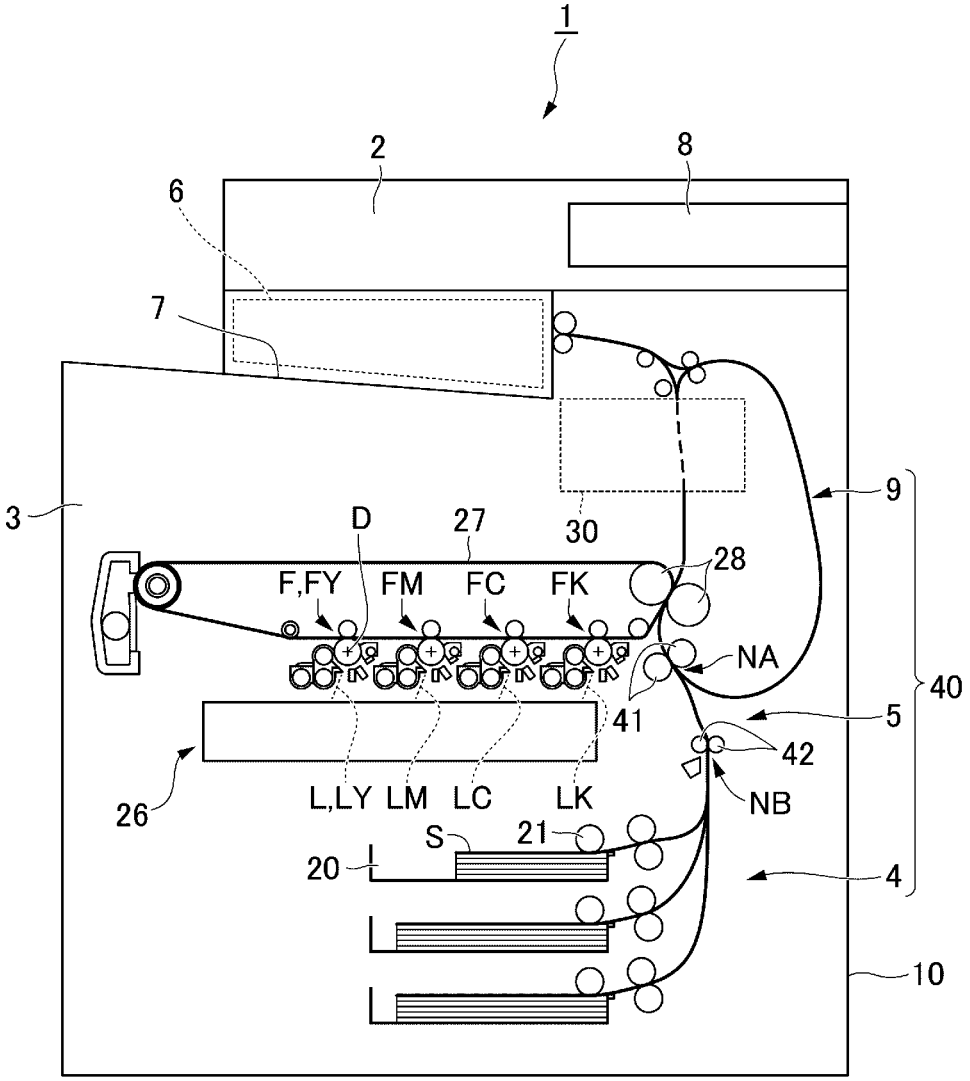
FIG. 1 is an explanatory diagram illustrating an example of a configuration of an image forming apparatus.

FIG. 1 is a schematic configuration diagram of an image forming apparatus. For example, an image forming apparatus 1 is disposed in a workplace such as an office. The image forming apparatus 1 performs processing for forming an image on a sheet S. The sheet S may be paper. The image forming apparatus 1 includes a housing 10, a scanner section 2, an image forming unit 3, a sheet supply section 4, a conveying section 5, a reversing unit 9, a tray 7, a control panel 8, and a control section 6.

The housing 10 forms the exterior of the image forming apparatus 1.

The scanner section 2 reads image information of a copy target object based on brightness and darkness of light and generates an image signal. The scanner section 2 outputs the generated image signal to the image forming unit 3.

The image forming unit 3 forms a toner image based on an image signal received from the scanner section 2 or the outside. The toner image is an image formed by toner or other materials. The image forming unit 3 transfers the toner image onto the surface of the sheet S. The image forming unit 3 heats and pressurizes the toner image on the surface of the sheet S and fixes the toner image on the sheet S.

The sheet supply section 4 supplies sheets S to the conveying section 5 one by one to be timed to coincide with the formation of the toner image by the image forming unit 3. The sheet supply section 4 includes a sheet storing section 20 and a pickup roller 21.

The sheet storing section 20 stores the sheets S of a predetermined size and a predetermined type.

The pickup roller 21 picks up the sheets S from the sheet storing section 20 one by one. The pickup roller 21 supplies the picked-up sheet S to the conveying section 5.

The conveying section 5 conveys the sheet S supplied from the sheet supply section 4 to the image forming unit 3. The conveying section 5 includes a conveying roller unit 42 and a registration roller unit 41.

The conveying roller unit 42 conveys the sheet S supplied from the pickup roller 21 to the registration roller unit 41. The conveying roller unit 42 strikes the leading end in a conveying direction of the sheet S against a first nip NA.

The registration roller unit 41 bends the sheet S in the first nip NA to thereby align the position of the leading end of the sheet S in the conveying direction. The registration roller unit 41 conveys the sheet S according to timing when the image forming unit 3 transfers the toner image onto the sheet S.

The image forming unit 3 is explained.

The image forming unit 3 includes a plurality of image forming sections F, a laser scanning unit 26, an intermediate transfer belt 27, a transfer section 28, and a fixing device 30.

The image forming sections F include photoconductive drums D. The image forming sections F form toner images corresponding to image signals on the photoconductive drums D. A plurality of image forming sections FY, FM, FC, and FK respectively form toner images by toners of yellow, magenta, cyan, and black.

Chargers charge the surfaces of the photoconductive drums D. Developing devices store developers including toners of yellow, magenta, cyan, and black. The developing devices develop electrostatic latent images on the photoconductive drums D in order to form toner images of the colors on the photoconductive drums D.

The laser scanning unit 26 scans the charged photoconductive drums D with laser light L to expose the photoconductive drums D. The laser scanning unit 26 exposes the photoconductive drums D with separate laser lights LY, LM, LC, and LK in order to form electrostatic latent images on the photoconductive drums D of the image forming sections FY, FM, FC, and FK for the colors.

The toner images on the surfaces of the photoconductive drums D are primarily transferred onto the intermediate transfer belt 27.

The transfer section 28 transfers the toner images primarily transferred on the intermediate transfer belt 27 onto the surface of the sheet S in a secondary transfer position.

The fixing device 30 carries out fixing processing. The fixing processing is processing for heating and pressurizing the toner images transferred onto the sheet S and fixing the toner images on the sheet S.

The reversing unit 9 reverses the sheet S in order to form an image on the rear surface of the sheet S. The reversing unit 9 reverses, with switchback, the front and the rear of the sheet S discharged from the fixing device 30. The reversing unit 9 conveys the reversed sheet S toward the registration roller unit 41.

The sheet S discharged with an image formed thereon is placed on the tray 7.

The control panel 8 is a part of an input section to which an operator inputs information for operating the image forming apparatus 1. The control panel 8 includes a touch panel and various hard keys.

The control section 6 controls operations of the sections of the image forming apparatus 1.

Figure 2:
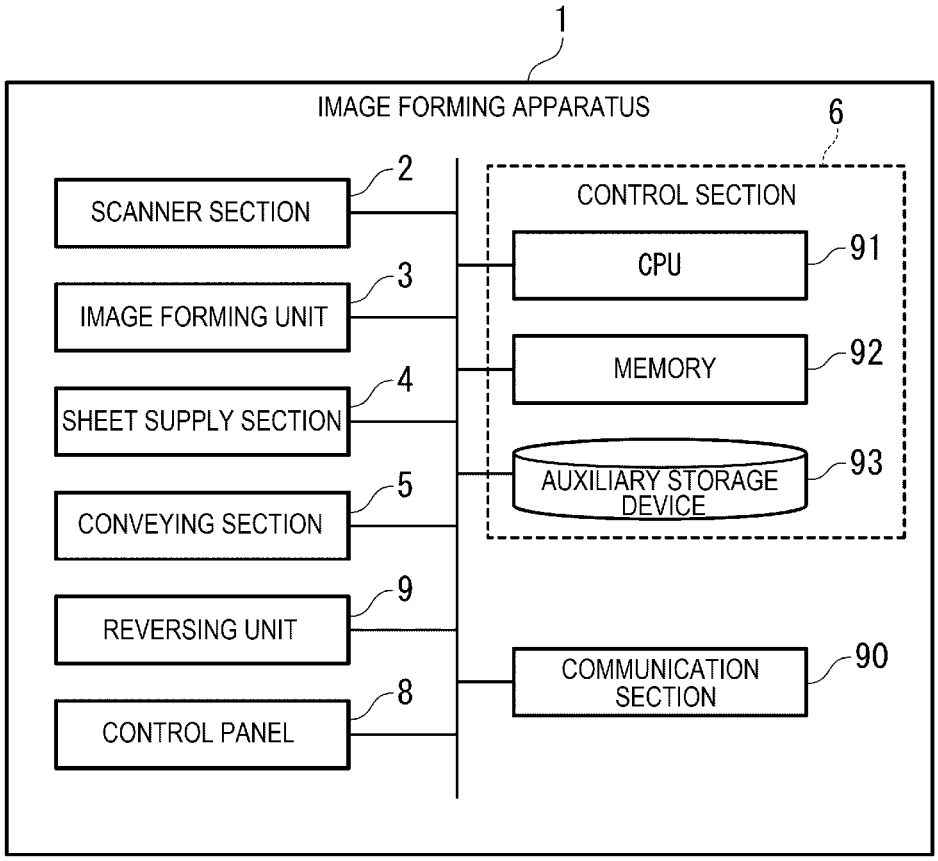
FIG. 2 is a hardware configuration diagram of the image forming apparatus.

FIG. 2 is a hardware configuration diagram of the image forming apparatus in the embodiment. The image forming apparatus 1 includes a CPU (Central Processing Unit) 91, a memory 92, and an auxiliary storage device 93 connected by a bus and executes a program. The image forming apparatus 1 executes the program to thereby function as an apparatus including the scanner section 2, the image forming unit 3, the sheet supply section 4, the conveying section 5, the reversing unit 9, the control panel 8, and a communication section 90.

The CPU 91 executes a program stored in the memory 92 and the auxiliary storage device 93 to thereby function as the control section 6. The control section 6 controls operations of the functional sections of the image forming apparatus 1.

The auxiliary storage device 93 is configured using a storage device such as a magnetic hard disk device or a semiconductor storage device. The auxiliary storage device 93 stores information.

The communication section 90 includes a communication interface for connecting the image forming apparatus 1 to an external apparatus. The communication section 90 communicates with the external apparatus via the communication interface.

As illustrated in FIG. 1, the image forming apparatus 1 includes a sheet conveying device 40. The sheet conveying device 40 includes the sheet supply section 4, the conveying section 5, and the reversing unit 9 explained above. The sheet conveying device 40 includes the image forming unit 3 and the control section 6 explained above.

The sheet conveying device 40 includes a first roller unit and a second roller unit. In the conveying direction of the sheet S, the first roller unit is present on a downstream side and the second roller unit is present on an upstream side. For example, the first roller unit is the registration roller unit 41 and the second roller unit is the conveying roller unit 42.

The sheet conveying device 40 includes the registration roller unit (the first roller unit) 41, a first conveyance path PA, a guide mechanism 50, a second conveyance path PB, the conveying roller unit (the second roller unit) 42, a sensor 47, and the control section 6.

Figure 3:
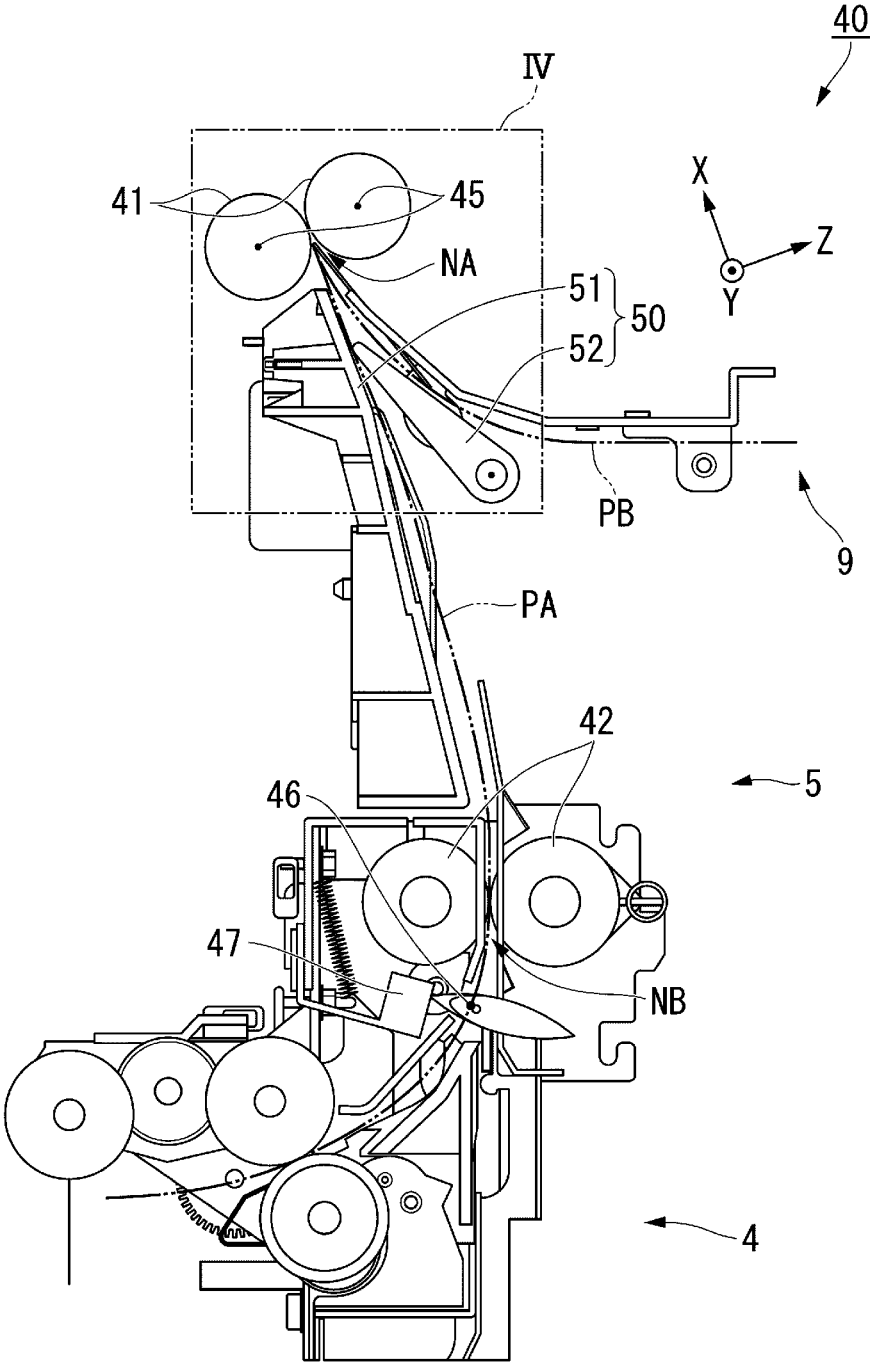
FIG. 3 is a front sectional view of a sheet conveying device in an embodiment.

FIG. 3 is a front sectional view of the sheet conveying device 40 in the embodiment.

The registration roller unit 41 forms the first nip NA with a pair of rollers. The registration roller unit 41 bends the leading end of the sheet S having reached the first nip NA to align the posture of the sheet S. The pair of rollers of the registration roller unit 41 respectively rotates around rotation axes 45 of the pair of rollers. The registration roller unit 41 conveys the sheet S to the image forming unit 3 at predetermined timing.

As illustrated in FIG. 3, the first conveyance path PA is a conveyance path for conveying the sheet S to the registration roller unit 41. The first conveyance path PA is a conveyance path for the sheet S leading from the sheet supply section 4 to the registration roller unit 41.

The guide mechanism 50 guides the conveyance of the sheet S. The guide mechanism 50 includes a first guide 51 and a second guide 52. The first guide 51 and the second guide 52 are disposed along the first conveyance path PA.

In this specification, an X direction, a Y direction, and a Z direction of an orthogonal coordinate system are defined as follows. The X direction (a first direction) is the conveying direction of the sheet S in the first conveyance path PA. A −X direction (a first side in the first direction) is the upstream side in the conveying direction of the sheet S. A +X direction (a second side in the first direction) is the opposite side of the −X direction and is a downstream side in the conveying direction of the sheet S. The Y direction is a width direction of the sheet S conveyed on the first conveyance path PA. The Z direction (a second direction) is a thickness direction of the sheet S conveyed on the first conveyance path PA. A −Z direction (a first side in the second direction) is the first guide 51 side of the first conveyance path PA. A +Z direction (a second side in the second direction) is the opposite side of the −Z direction and is the second guide 52 side of the first conveyance path PA.

The guide mechanism 50 is present in the −X direction of the registration roller unit 41.

The first guide 51 is present in the −Z direction of the first conveyance path PA. The first guide 51 extends in the X direction along the first conveyance path PA. A relative position of the first guide 51 is fixed with respect to the rotation axes 45 of the registration roller unit 41.

Figure 4:
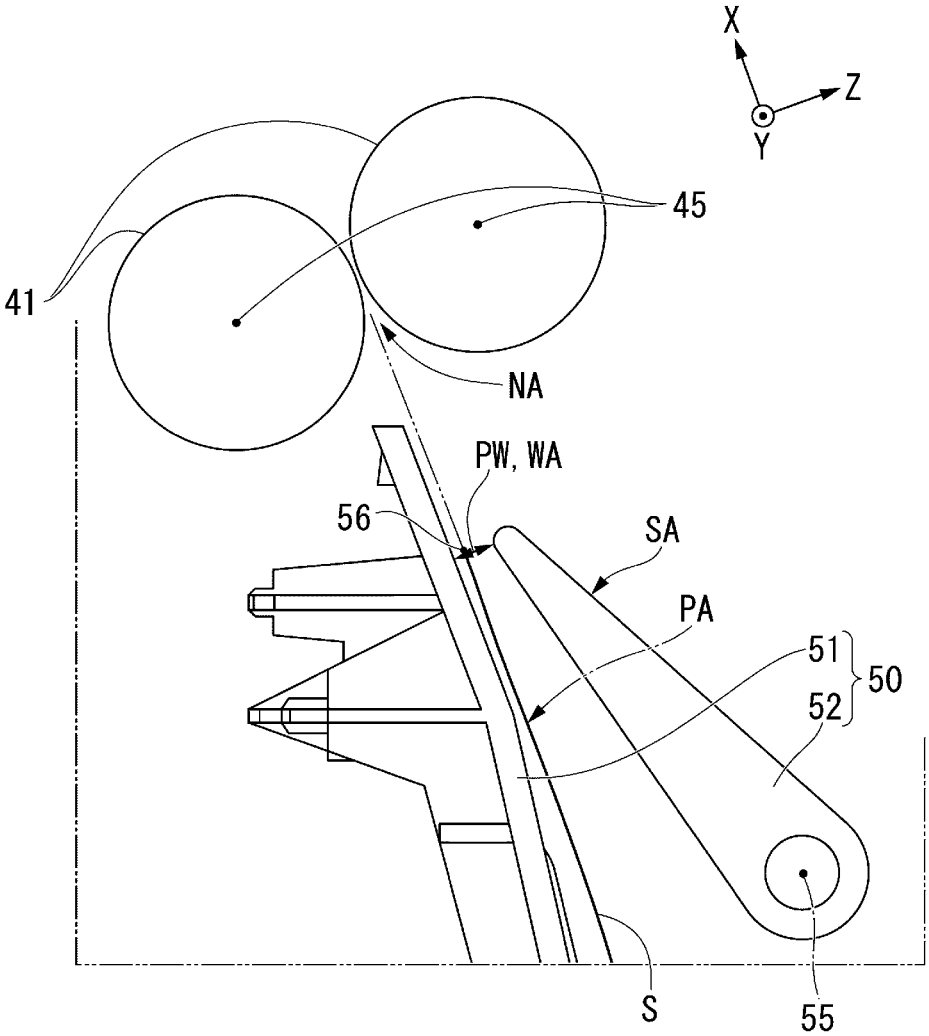
FIG. 4 is a first operation explanatory diagram of a guide mechanism.

FIG. 4 is a first operation explanatory diagram of the guide mechanism 50 and is an enlarged diagram of an IV portion in FIG. 3.

The second guide 52 is present in the +Z direction of the first conveyance path PA. The second guide 52 extends in the X direction along the first conveyance path PA. The second guide 52 approaches the first guide 51 in the −X direction to the +X direction. The guide mechanism 50 guides the sheet S toward the first nip NA of the registration roller unit 41.

The second guide 52 is movable relatively to the first guide 51. The second guide 52 is capable of turning around a turning axis 55. The turning axis 55 is parallel to the Y direction. The turning axis 55 is present at the end portion in the −X direction of the second guide 52. A driving mechanism of the second guide 52 turns the second guide 52.

The guide mechanism 50 is capable of changing a conveyance path width PW. The conveyance path width PW is the width in the Z direction in a first position 56 of the first conveyance path PA. The first position 56 is a position between the distal end in the +X direction of the second guide 52 and the first guide 51. The conveyance path width PW is the width between the distal end in the +X direction of the second guide 52 and the first guide 51. If the second guide 52 turns around the turning axis 55, the conveyance path width PW changes.

In FIG. 4, the second guide 52 is in a first state SA. The distal end in the +X direction of the second guide 52 in the first state SA is separated from the first guide 51. The conveyance path width PW at the time when the second guide 52 is in the first state SA is first width WA.

Figure 5:
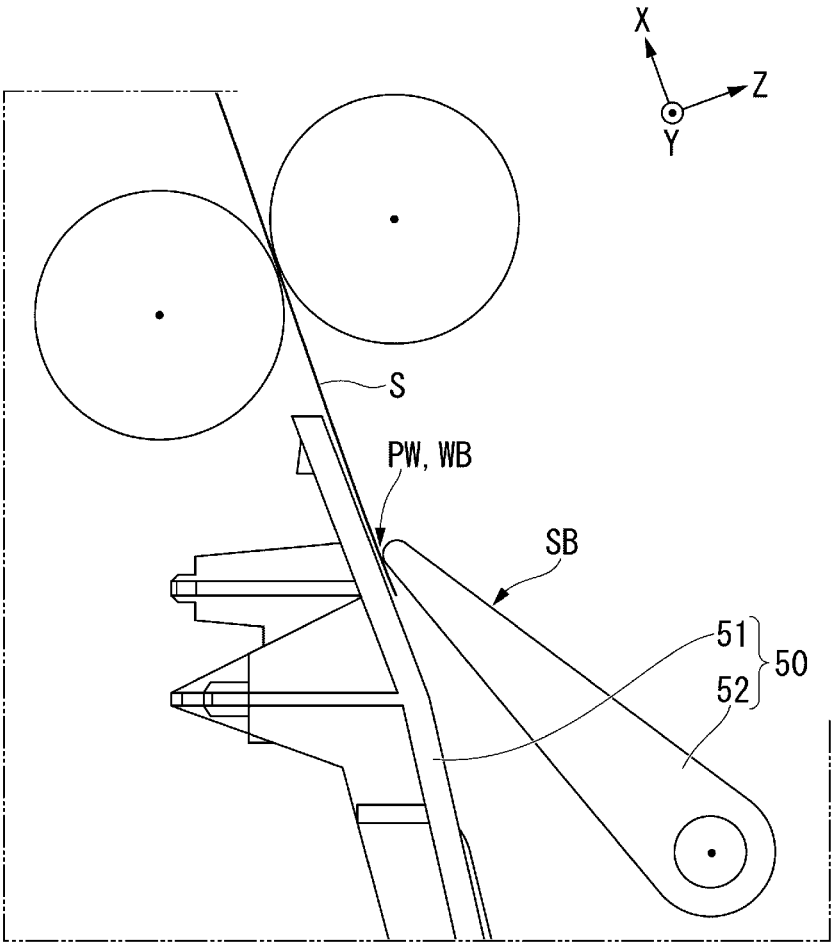
FIG. 5 is a second operation explanatory diagram of the guide mechanism.

FIG. 5 is a second operation explanatory diagram of the guide mechanism 50 and is an enlarged diagram of the IV portion in FIG. 3.

In FIG. 5, the second guide 52 is in a second state SB. The distal end in the +X direction of the second guide 52 in the second state SB is approaching the first guide 51. The conveyance path width PW at the time when the second guide 52 is in the second state SB is second width WB. The second width WB is smaller than the first width WA. The second guide 52 is capable of turning between the first state SA and the second state SB.

As illustrated in FIG. 3, the second conveyance path PB is a conveyance path for the sheet S in the reversing unit 9. The second conveyance path PB is a conveyance path for reversing the front and the rear of the sheet S having passed through the registration roller unit 41 and conveying the sheet S to the registration roller unit 41. The first conveyance path PA and the second conveyance path PB merge near the registration roller unit 41 in the −X direction. The second guide 52 is disposed between the first conveyance path PA and the second conveyance path PB in the −X direction of a merging point of the first conveyance path PA and the second conveyance path PB.

The conveying roller unit 42 is present in the first conveyance path PA in the −X direction of the registration roller unit 41. The conveying roller unit 42 rotates while forming a second nip NB with a pair of rollers. The conveying roller unit 42 conveys, along the first conveyance path PA, the sheet S having reached the second nip NB.

The sensor 47 detects passage of the trailing end of the sheet S in a second position 46 of the first conveyance path PA. The second position 46 is a position near the conveying roller unit 42 in the −X direction. For example, the sensor 47 is an optical sensor (a photosensor). If detecting the passage of the trailing end of the sheet S, the sensor 47 transmits a detection signal to the control section 6.

The control section 6 receives the detection signal of the sensor 47. The control section 6 controls turning of the second guide 52 of the guide mechanism 50.

If receiving the detection signal of the sensor 47, the control section 6 shifts the second guide 52 to the second state SB illustrated in FIG. 5. Consequently, the conveyance path width PW is set to the second width WB. If the trailing end of the sheet S passes the second position 46, the intermediate portion of the sheet S is passing the first position 56. The control section 6 maintains the conveyance path width PW at the second width WB. As illustrated in FIG. 5, if the trailing end of the sheet S passes the first position 56 of the guide mechanism 50, the conveyance path width PW is maintained at the second width WB.

Before the trailing end of the sheet S passes through the registration roller unit 41, the trailing end of the sheet S is in an unconstraint (free) state. In the −X direction of the registration roller unit 41, the trailing end of the sheet S sometimes vibrates (jumps) in the Z direction. The conveyance path width PW at the time when the trailing end of the sheet S passes through the guide mechanism 50 is set to the small second width WB. The trailing end of the sheet S does not greatly vibrate in the Z direction. Even if the trailing end of the sheet S comes into contact with the guide mechanism 50, large sound does not occur. Consequently, noise during the conveyance of the sheet S is suppressed.

After the trailing end of the sheet S passed through the conveying roller unit 42, the trailing end of the sheet S changes to the unconstraint state. Before the trailing end of the sheet S passes through the conveying roller unit 42, the control section 6 shifts the conveyance path width PW to the second width WB. The trailing end of the sheet S after having passed through the conveying roller unit 42 does not greatly vibrate in the Z direction. Consequently, noise during the conveyance of the sheet S is suppressed.

If a predetermined time elapsed after the detection signal of the sensor 47 was received, the control section 6 shifts the second guide 52 to the first state SA illustrated in FIG. 4. Consequently, the conveyance path width PW is set to the first width WA. If a predetermined time elapsed after the trailing end of the sheet S passed the second position 46, the trailing end of the sheet S already passed the first position 56. The control section 6 maintains the conveyance path width PW at the first width WA. As illustrated in FIG. 4, if the leading end of the following sheet S passes the first position 56 of the guide mechanism 50, the conveyance path width PW is maintained at the first width WA.

The registration roller unit 41 bends, in the Z direction, the leading end of the sheet S having reached the first nip NA to align the posture of the sheet S. The conveyance path width PW at the time when the leading end of the sheet S passes through the guide mechanism 50 is set to the large first width WA. The leading end of the sheet S easily bends in the Z direction. Consequently, conveyance resistance of the sheet S is suppressed.

The control section 6 may control an operation of the guide mechanism 50 according to a type of the sheet S. A user of the image forming apparatus 1 inputs, to the control panel 8, a type of the sheet S to be subjected to image formation. The control section 6 determines whether the sheet S to be subjected to image formation is a sheet having thickness equal to or larger than a predetermined value. If the sheet S is a first sheet having thickness equal to or larger than the predetermined value, the control section 6 sets the conveyance path width PW at the time when the trailing end of the first sheet passes through the guide mechanism 50 to the second width WB.

If the trailing end of the thick first sheet vibrates in the Z direction and comes into contact with the guide mechanism 50, large sound occurs. The conveyance path width PW at the time when the trailing end of the first sheet passes through the guide mechanism 50 is set to the small second width WB. Consequently, noise during conveyance of the thick first sheet is suppressed.

If the sheet S is a second sheet having thickness smaller than the predetermined value, the control section 6 sets the conveyance path width PW at the time when the trailing end of the second sheet passes through the guide mechanism 50 to the first width WA. Even if receiving the detection signal of the sensor 47, the control section 6 does not shift the second guide 52 to the second state SB illustrated in FIG. 5.

The control section 6 maintains the conveyance path width PW during conveyance of the second sheet at the first width WA.

Even if the trailing end of the thin second sheet greatly vibrates in the Z direction and comes into contact with the guide mechanism 50, large sound does not occur. The conveyance path width PW during the conveyance of the second sheet is maintained at the large first width WA. Since the second guide 52 is maintained in the first state SA, noise involved in the turning of the second guide 52 does not occur.

A first modification of the embodiment is explained.

Figure 6:
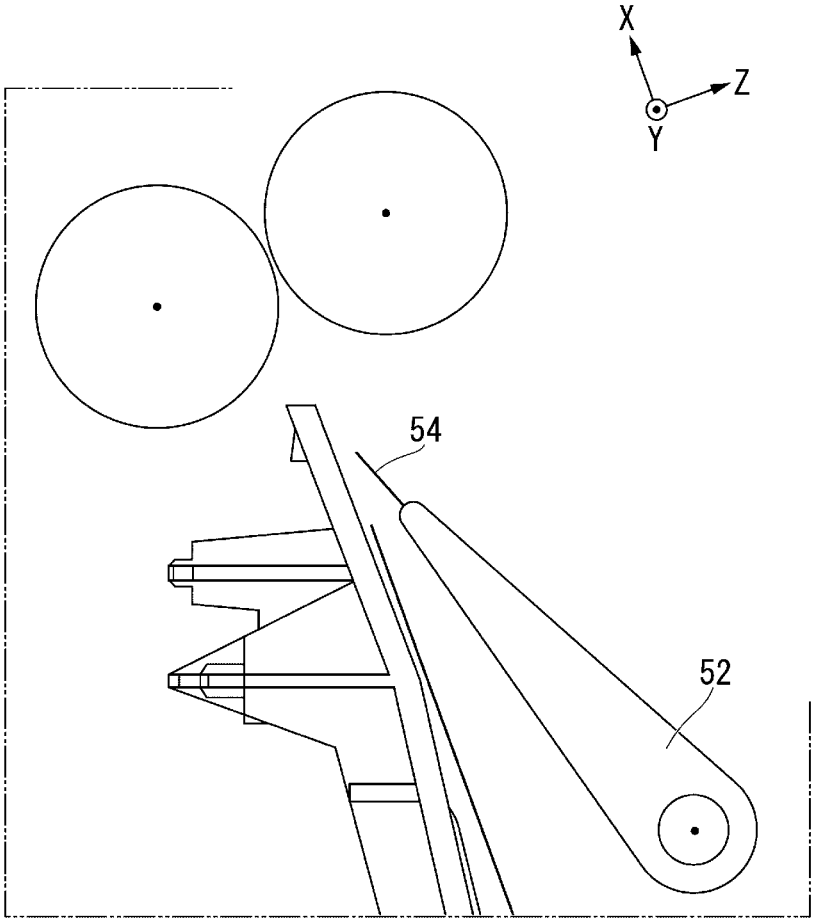
FIG. 6 is a front sectional view of a guide mechanism in a first modification of the embodiment.

FIG. 6 is a front sectional view of the guide mechanism 50 in the first modification of the embodiment and is an enlarged diagram of a portion equivalent to the IV portion in FIG. 3. The first modification is different from the embodiment in that the guide mechanism 50 includes a film 54 at the distal end of the second guide 52. Explanation of the first modification concerning similarities to the embodiment is sometimes omitted.

The second guide 52 includes a flexible film (Mylar) 54 at the distal end in the +X direction. The film 54 is formed in a thin-plate shape by a resin material or the like. The width in the Y direction of the film 54 may be the same as the width of the second guide 52 or may be smaller than the width of the second guide 52.

The sheet S conveyed on the first conveyance path PA comes into contact with the film 54 of the second guide 52. Since the film 54 has flexibility, occurrence of damage and noise of the sheet S is suppressed.

In the embodiment explained above, as an example, the first roller unit is the registration roller unit 41 and the second roller unit is the conveying roller unit 42. In contrast, the first roller unit and the second roller unit may be combinations of other roller units. The second roller unit only has to be present in the −X direction of the first roller unit. For example, the first roller unit may be the conveying roller unit 42 and the second roller unit may be a unit of a paper feeding roller and a separation roller in the sheet supply section 4. The first roller unit may be a roller unit of the transfer section 28 in the image forming unit 3 and the second roller unit may be the registration roller unit 41. The first roller unit may be a unit of a pressurizing roller and a heating roller in the fixing device 30 and the second roller unit may be a roller unit of the transfer section 28 in the image forming unit 3.

According to at least one embodiment explained above, the sheet conveying device 40 includes the registration roller unit 41, the first conveyance path PA, the guide mechanism 50, and the control section 6. The registration roller unit 41 rotates while forming the first nip NA with the pair of rollers and conveys the sheet S having reached the first nip NA. The first conveyance path PA conveys the sheet S to the registration roller unit 41. The upstream side in the conveying direction of the first conveyance path PA is represented as the −X direction. The thickness direction of the sheet S conveyed on the first conveyance path PA is represented as the Z direction. The guide mechanism 50 is disposed along the first conveyance path PA and guides the conveyance of the sheet S. The guide mechanism 50 is capable of changing the conveyance path width PW, which is the width in the Z direction of the first conveyance path PA. The control section 6 is capable of controlling the guide mechanism 50 as explained below. The control section 6 sets the conveyance path width PW at the time when the leading end of the sheet S passes the first position 56 of the guide mechanism 50 to the first width WA. The control section 6 sets the conveyance path width PW at the time when the trailing end of the sheet S passes the first position 56 of the guide mechanism 50 to the second width WB smaller than the first width WA. Consequently, it is possible to suppress noise during the conveyance of the sheet S.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet conveying device, comprising:

a first roller configured to rotate while forming a first nip with another roller and convey a sheet having reached the first nip;

a first conveyance path for conveying the sheet to the first roller;

a guide mechanism disposed along the first conveyance path and configured to guide the conveyance of the sheet and change a conveyance path width, the conveyance path width exists in a second direction of the first conveyance path, if an upstream side in a conveying direction of the first conveyance path is represented as a first side in a first direction and a thickness direction of the sheet conveyed on the first conveyance path is represented as the second direction;

a controller configured to control the guide mechanism to set the conveyance path width at a time when a leading end of the sheet passes a first position of the guide mechanism to a first width and set the conveyance path width at a time when a trailing end of the sheet passes the first position of the guide mechanism to a second width smaller than the first width;

a second roller present on the first side in the first direction of the first roller and configured to rotate while forming a second nip with yet another roller and convey the sheet having reached the second nip; and a sensor configured to detect passage of a trailing end of the sheet in a second position on the first side in the first direction of the second roller, wherein the controller sets the conveyance path width to the second width if the sensor detects the passage of the trailing end of the sheet in the second position.

2. The sheet conveying device according to claim 1, wherein the guide mechanism includes a first guide present on a first side in the second direction of the first conveyance path and a second guide present on a second side in the second direction of the first conveyance path if an opposite side of the first side in the second direction is represented as the second side in the second direction, a relative position of the first guide is fixed with respect to a rotation axis of the first roller, and the second guide is movable relatively to the first guide.

3. The sheet conveying device according to claim 2, wherein the second guide is capable of turning around a turning axis.

4. The sheet conveying device according to claim 3, wherein the turning axis is present at an end portion on the first side in the first direction of the second guide, if an opposite side of the first side in the first direction is represented as a second side in the first direction, the second guide approaches the first guide on the first side in the first direction to the second side in the first direction, the first position is between a distal end on the second side in the first direction of the second guide and the first guide, and the conveyance path width is between the distal end on the second side in the first direction of the second guide and the first guide.

5. The sheet conveying device according to claim 4, wherein the second guide includes a flexible film at a distal end on the second end side in the first direction.

6. The sheet conveying device according to claim 2, further comprising a second conveyance path for reversing a front and a rear of the sheet having passed through the first roller and conveying the sheet to the first roller, wherein the second guide is disposed between the first conveyance path and the second conveyance path.

7. The sheet conveying device according to claim 1, wherein the controller sets the conveyance path width to the first width if a predetermined time elapsed after the sensor detected the passage of the trailing end of the sheet.

8. The sheet conveying device according to claim 1, further comprising an image forming component configured to form an image on a sheet, wherein the first roller is a registration roller assembly configured to align a posture of the sheet having reached the first nip and supply the sheet to the image forming component at predetermined timing.

9. A sheet conveying method, comprising:

rotating a first roller while forming a first nip with another roller and conveying a sheet having reached the first nip;

conveying the sheet to the first roller via a first conveyance path;

guiding, using a guide mechanism disposed along the first conveyance path, the conveyance of the sheet and changing a conveyance path width, the conveyance path width exists in a second direction of the first conveyance path, if an upstream side in a conveying direction of the first conveyance path is represented as a first side in a first direction and a thickness direction of the sheet conveyed on the first conveyance path is represented as the second direction;

setting the conveyance path width at a time when a leading end of the sheet passes a first position of the guide mechanism to a first width and setting the conveyance path width at a time when a trailing end of the sheet passes the first position of the guide mechanism to a second width smaller than the first width;

rotating a second roller present on the first side in the first direction of the first roller while forming a second nip with yet another roller and conveying the sheet having reached the second nip;

detecting passage of a trailing end of the sheet in a second position on the first side in the first direction of the second roller; and setting the conveyance path width to the second width if the passage of the trailing end of the sheet in the second position is detected.

10. The sheet conveying method according to claim 9, further comprising:

setting the conveyance path width to the first width if a predetermined time elapsed after the passage of the trailing end of the sheet is detected.

11. The sheet conveying method according to claim 9, further comprising:

reversing a front and a rear of the sheet having passed through the first roller via a second conveyance path and conveying the sheet to the first roller.

12. A sheet conveying method, comprising:

rotating a first roller while forming a first nip with another roller and conveying a sheet having reached the first nip;

conveying the sheet to the first roller via a first conveyance path;

guiding, using a guide mechanism disposed along the first conveyance path, the conveyance of the sheet and changing a conveyance path width, the conveyance path width exists in a second direction of the first conveyance path, if an upstream side in a conveying direction of the first conveyance path is represented as a first side in a first direction and a thickness direction of the sheet conveyed on the first conveyance path is represented as the second direction;

setting the conveyance path width at a time when a leading end of the sheet passes a first position of the guide mechanism to a first width and setting the conveyance path width at a time when a trailing end of the sheet passes the first position of the guide mechanism to a second width smaller than the first width;

if the sheet is a first sheet having thickness equal to or larger than a predetermined value, setting the conveyance path width at a time when a trailing end of the first sheet passes the guide mechanism to the second width; and if the sheet is a second sheet having thickness smaller than the predetermined value, setting the conveyance path width at a time when a trailing end of the second sheet passes the guide mechanism to the first width.

* * * * *